United States Patent [19]

Whitworth

[11] Patent Number: 4,915,707

[45] Date of Patent: Apr. 10, 1990

[54] PROCESS FOR PURIFYING LIMONENE FOR FUEL AND THE LIKE

[75] Inventor: Robert D. Whitworth, Houston, Tex.

[73] Assignee: Lemco Energy, Inc., Greenville, S.C.

[21] Appl. No.: 332,583

[22] Filed: Apr. 3, 1989

Related U.S. Application Data

[62] Division of Ser. No. 111,914, Oct. 21, 1987, Pat. No. 4,818,250.

[51] Int. Cl.[4] ..... C10L 1/22

[52] U.S. Cl. ..... 44/62; 44/72

[58] Field of Search ..... 44/62, 72

[56] References Cited

U.S. PATENT DOCUMENTS 4,533,487 8/1985 Jones ..... 252/153

4,617,025 10/1986 Naiman et al. ..... 44/62

4,620,855 11/1986 Higgins ..... 44/62

4,623,363 11/1986 Zaweski et al. ..... 44/62

4,818,250 4/1989 Whitworth ..... 44/62

FOREIGN PATENT DOCUMENTS 0096689 6/1983 Japan ..... 44/62

*Primary Examiner*—Jacqueline V. Howard

*Attorney, Agent, or Firm*—Dority & Manning

[57] ABSTRACT

A plant source fuel is disclosed per se and as a blend constituent for conventional petroleum fuels along with a process for producing same. Limonene obtained from citrus and other plants when distilled and treated to avoid formation of gums is blendable with conventional petroleum fuels up to about 20 volume percent to form blends that meet the standards for such fuels.

9 Claims, 1 Drawing Sheet

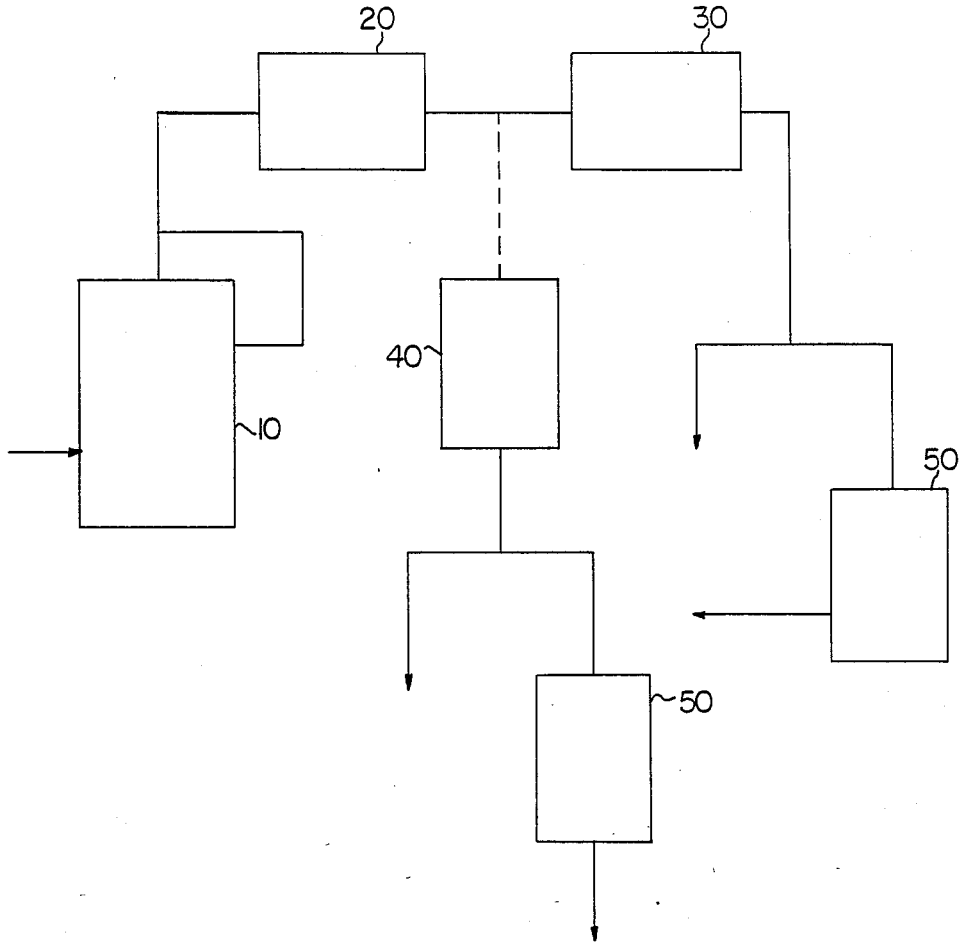
20
30
40
10
50
50

PROCESS FOR PURIFYING LIMONENE FOR FUEL AND THE LIKE

This is a division of application Ser. No. 07/111,914, now U.S. Pat. No. 4,818,250.

The present invention relates to an improved fuel as a substitute for fossil fuels. Fuels according to the present invention may be used in general combustion environs such as fuel heaters, in spark ignition engines such as internal combustion and diesel engines, and the like; as a fossil fuel blending component, and to a process for producing same.

In recent years, it has become apparent that global uses of fossil fuels are outstripping the naturally occurring supply of same. Moreover, Eastern countries which control a significant share of the world reserves of fossil fuels have from time to time imposed artificial controls on the production and/or selling price of fossil fuels, resulting in potential fuel problems for the rest of the world. While to date, no real crisis has surfaced, the ever present potential for same keeps the fossil fuel issue at the forefront of global problems and concerns.

While prior efforts have been made to arrive at solutions to the problems attendant to depletion and imposed controls of fossil fuels, no true solution has surfaced heretofore. Notably, during a most recent period of fuel shortage in the early 1970's, searches for alternative fuel solutions were rampant for automotive, home and other environs. Notably, a tremendous emphasis was placed on the use of wood burning stoves in order to reduce the demands for electricity. Such efforts have, in fact, met more than minor success to the point where millions of wood burning stoves are in use today in both domestic and industrial settings to supplant, if not reduce, the consumption of electrical power for heating purposes and thereby reducing fossil fuel consumption for generation of electrical power.

Relevant to the automotive industry, again significant technical effort has been made to improve the efficiency of the internal combustion engine. The internal combustion engine is known to operate it a relatively low efficiency level, thus leaving appreciable room for improvement. New carbuerators have been developed as well as new processes for the handling of gasoline fuels used to operate the internal combustion engines such as by vaporization of the fuel prior to is introduction to the firing chambers.

Further efforts have also been made in a slightly different direction, that is, to search for fuel sources that are not dependent on thousands of years for replenishment, but which may be replenished in relatively short periods of time. One such effort has been the conversion of grain crops to ethanol with the subsequent blending of the enthanol with conventional gasoline fuels. Again, while the overall scope of the project has met with some success, the uses of blends of gasoline and ethanol has not been universally accepted. In addition to the use of ethanol as an additive to gasoline produced from fossil fuels, other materials have likewise been tried, but for various economic or technological reasons none has achieved success to date. By way of example, U.S. Pat. No. 4,131,434 to Gonzalez is directed to a fuel additive for oil, diesel oil and gasoline to improve fuel efficiency and reduce resulting air pollutants. Included as the Gonzalez additives are aromatic and aliphatic hydrocarbon solvents with and without oxygenated functional groups, terpenes and aromatic nitrogen containing compounds.

A further effort to improve combustion efficiency of fossil fuel gasoline is set forth in Japanese Pat. No. 58 96,689 which is directed to the use of plant oils containing menthadiene or limonene as fuel additives to improve the octane numbers of fuels. The compounds are stated to have a boiling range similar to that of gasoline with a commercial orange oil containing limonene stated to have an octane number of 137.7.

Still further , U.S. Pat. No. 2,402,863 to Zuidema et al. is directed to blended gasoline of improved stability and more particularly, leaded gasoline containing up to about 10% alicyclic olefins which preferably contain a cyclohexene ring. Zuidema et al. state in their patent that they have determined that the presence of cyclic olefins tend to stabilize leaded gasoline. Cyclic olefin is defined as an alicyclic hydrocarbon containing an olefin double bond in the ring (preferably no more than one). The alicyclic olefins are suggested to be available from terpenes or from synthesis such as partial dehydrogenation of naphthenes. A number of individual cyclic olefins are stated as being suitable. For example, terpenes such as di-limonene (citrene) and d=l limonene (dipentene). Zuidema et al further state that oxidation inhibitors may also be included with aromatic amino inhibitors such as those based on paraphenylene diamine, para amino phenol and alpha naphthylamine being especially useful.

The present invention is yet another effort to provide an alternative to fossil fuels that may be generated from various plant sources, most notably citrus plants and which represents improvement over those attempts noted above. Neither the process for producing the fuel according to the present invention, nor the product per se, is taught or suggested by any known prior art, including that set forth above.

SUMMARY OF THE INVENTION

It is an object of the present invention to provide a fuel derived from plants.

Another object of the present invention is to provide an improved additive for blending with fossil fuels.

Still another object of the present invention is to provide an improved plant based fuel as a blending component for motor, diesel and aviation fuels as well as heating fuels.

Yet another object of the present invention is to provide an improved fuel derived from plants that meets fuel specifications of the American Society of Testing and Materials for petroleum fuels.

Still another object of the present invention is to provide a process for the production of an improved fuel derived from plants.

Generally speaking, the process of the present invention for producing an improved fuel from plant sources comprises the steps of supplying a quantity of limonene; distilling the limonene and recovering the distillate fraction in a range equivalent from about 346° F. to about 382° F. based on atmospheric distillation; and treating the distilled limonene to at least reduce the formation of gums during combustion of the fuel, whereby the fuel meets ASTM standards for petroleum fuels.

More specifically, in practicing the process of the present invention, the limonene product is processed in an atmospheric distillation unit with the high purity limonene distillate being recovered while discarding any products coming over outside of the recited range and bottoms remaining in the still. Subsequent to distillation according to a preferred process, the distilled limonene is dried to remove water therefrom. Specifically, the limonene is passed through a vessel containing a drying agent such as silica gel, where the water content of same is reduced from about 0.1 weight percent to a level of about 0.01 weight percent.

Treatment to preclude the formation of gums during combustion can take one or two directions. The distilled limonene can be subjected to a vessel in which antioxidant is injected into the limonene in a nitrogen stream in an amount of from about 2 to about 100 pounds per thousand barrels of limonene, preferably about 10 pounds per thousand barrels of limonene. While a number of different antioxidants may be employed, preferred antioxidants are the phenylenediamenes. The presence of an antioxidant in the limonene fuel inhibits reactivity of the olefinic double bonds, thus precluding gum formation during combustion of the fuel. In instances, however, where storage requirements are prolonged, shelf life of the efficacy of the antioxidant becomes important.

In a further approach to precluding the formation of gums, the distilled limonene can be subjected to a hydrogenation process where the olefinic double bonds are broken and the sites hydrogenated. Hydrogenation thus converts the limonene to a saturated compound which permanently precludes the formation of gums, wherefore shelf life is less of a concern.

The limonene fuel product produced according to the above process generally meets all of the standard physical characteristics for petroleum fuels such that it may be blended with the conventional fuels whether gasoline, diesel, aviation fuel, jet fuel or heat fuel. Surprisingly, the limonene fuel product exhibits a quite low vapor pressure with a high flash point such that when blended with conventional gasoline, the addition of the limonene product permits further substitution of certain levels of additional specific components which may be used to raise the overall octane number to a premium level, as exhibited by tertiary amyl methyl ether and/or a more economical component without lowering the octane number for the blend, such as butane. Such substitution would be permissable at about a 5 volume percent level.

By way of description, the limonene fuel product according to the present invention comprises colorless distilled limonene, said limonene having a purity of at least about 95 volume percent, a water level of no greater than about 0.1 weight percent, an octane number of less than about 90 and being characterized by the absence of available olefinic double bonds for formation of gums.

As noted above, depending upon the route taken for precluding gum formation, the limonene product may include a minor amount of antioxidant or may be hydrogenated to yield a saturated paraffin.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

The FIGURE is a schematic representation of a process for producing a suitable plant derived fuel according to the teachings of the present invention.

DESCRIPTION OF A PREFERRED EMBODIMENT

According to the broad teachings of the present invention, d-limonene, following extraction from citrus fruits, neroli, celery, caroway or the like may be processed to serve as a fuel compatible with virtually all liquid fossil fuels such as motor fuels, diesel fuels, turbine fuels and heating fuels.

In like fashion, l-limonene may be extracted from naturally occurring sources such as pine-needle oil, oil of fir, spearmint, and peppermint, and processed according to the present invention.

The extraction of limonene from citrus fruits or other sources does not serve as a part of the present invention, and will not be described herein. Processes for extraction of d-limonene, particularly from citrus fruits are available and in use for the production of both commercial and food grade d-limonene. Principally, however, d-limonene is now being used in the food or other industries as an additive for affording flavor or aromatic characteristics to the basic product to which it is added.

Limonene is a cyclic olefinic compound which normally would be avoided by the petroleum industry due to the olefinic double bonds in the product. Particularly, olefins are notorious gum producing compounds and residual gums in fuels are definitely to be avoided. When, however, limonene is processed as described hereinafter, subsequent gum formation will be precluded either by way of an inhibitor or permanently by way of saturation of an olefinic double bonds.

Referring now to the figure, a preferred process according to the present invention will be described in detail. The limonene product, preferably d-limonene obtained from citrus fruit, is charged into an atmospheric distillation unit 10 where it is distilled according to normal distillation techniques. Particularly, the limonene is heated in a still with volatiles passing upwardly through a distillation tower, preferably with plates and with the product taken off the tower within a certain temperature range, condensed and collected or directly passed to further processing equipment. d-limonene feedstock normally contains approximately 10–15% by weight contaminants which are removed in order to obtain a highly purified product. In a preferred arrangement the still is operated with a reflux ratio of from about 1 to 1 to about 1 to 4 with a reflux ratio of 1 to 1 preferred, and the limonene distillate is removed in a temperature range of from about 346° F. to about 382° F. Product, if any, recovered from the still below a boiling point of 346° F. would include contaminants, and are discarded. Likewise, bottoms remaining in the still after the end point of 382° F. are discarded. The resultant limonene product taken in a temperature range of 346° F. to 382° F. represents a highly purified d-limonene having a purity of about 97.8 percent.

After removal of the distilled limonene from the condensor associated with still 10, the purified limonene product is preferably dryed by passing same through a dessicant such as silica gel for removal of residual water. Particularly, the distilled limonene entering the drying vessel 20 has a water content of about 0.1 weight percent, while the limonene exiting the drying vessel contains water at a level of about 0.01 weight percent. Water, of course, not only adversely impacts on the efficiency of fuel combustion and the resultant power derived therefrom, but also adversely affects the freeze-thaw parameters of the fuel.

Subsequent to drying of the distilled limonene, the limonene is further processed to avoid the formation of gums during combustion. One of two alternate routes are preferred. As indicated in the figure and as most preferred, the limonene is fed to a hydrogenation unit 30 where the distilled limonene is hydrogenated to break and saturate the olefinic double bonds and to convert the limonene to a saturated paraffin. Elimination of unsaturation thus permanently precludes the gum formation problem from arising. Surprisingly, it has also been noted that upon subjecting the dried limonene to hydrogenation, an increase in octane number of the limonene is achieved. Octane numbers are obtained as a determination of the knock characteristics of the product. Generally, a research (R) octane number is obtained as well as a motor (M) octane number, with the octane number for the product being an average of the two, i.e.

$$\frac{R+M}{2}.$$

Reference hereinafter to octane number thus refers, unless otherwise stated, to the average according to the above formula.

As an alternate to hydrogenation of the distilled limonene, an anti-oxidant may be admixed therewith to inhibit gum formation. As indicated in the figure, the antioxidant addition would take place in vessel 40 instead of hydrogenation unit 30. In adding the anti-oxidant to the limonene, the anti-oxidant is dripped into a positive displacement injector system where it is first introduced into a nitrogen stream. The nitrogen-anti-oxidant stream is then injected into the limonene with nitrogen expelling oxygen from the unit such that the anti-oxidant is added to the limonene in a nitrogen atmosphere. While preferably ten pounds of anti-oxidant per one thousand barrels of limonene is added, amounts in a range of from about two to about one hundred pounds per thousand barrels may be utilized.

Once the limonene has been hydrogenated as in hydrogenation vessel 30 or mixed with an anti-oxidant in vessel 40, it is then ready for use. As indicated on the figure, the processed limonene serves as a suitable fuel per se, although preferably it is blended with conventional fossil fuels in a suitable blending tank 50 or the like to yield a final fuel containing up to about 20 volume percent limonene, and preferably from about 10–15 volume percent limonene.

The process limonene product described above generally meets all of the specifications for motor fuels as determined by the American Society of Testing and Materials hereinafter referred to both generally as by way of test methods as ASTM. For those characteristics not met by limonene per se, it is apparent that such would be met in a fuel blend containing up to about 20 volume percent limonene. Consequently, a limonene fuel per se or a blend of limonene processed according to the present invention with a conventional fossil fuel not only performs very satisfactorily, but also the blends totally qualify for use in existing commercial pipelines and other processing facilities.

One significant attribute to the limonene product processed according to the present invention which appears to represent an inconsistency for the ultimate use of same, is a lessened explosive nature. Particularly, limonene processed according to the present invention exhibits a low vapor pressure and a high flash point. Such coupled with it distillation characteristics and resistance to ignition in a pool fire test, appear inconsistent to success in operation of an unmodified internal combustion engine. As set forth in the following examples, however, both are correct. In fact, the pure limonene product after processing according to the present invention, will start and operate a conventional internal combustion engine in like manner as a conventional fossil fuel gasoline.

As a result of the attributes noted above, the limonene product according to the present invention represents a significant safety benefit when present in vehicular fuels. In fact, in land, air and marine uses, fuels containing the limonene product according to the present invention afford improvement in fire safety in post accident situations which, historically is often the cause of death following an airplane crash, automobile wreck or the like. Reduction of volatility of the conventional fuel affords yet a further safety front in military marine uses, and particularly for aircraft carriers where large quantities of aviation fuel and/or jet fuel must be stored.

Use of the industry processed limonene affords yet another and significant benefit to the petroleum industry. Notably, the addition of the limonene to commercial gasoline appreciably lowers the vapor pressure of the blend with little effect on the resultant octane number. Such characteristic permits the substitution of constituents in the blend to enhance economy and/or efficiency. For example, extra butane, methyl tertiary butyl ether, (MTBE) tertiary amyl methyl ether (TAME) or the like may be substituted for the like amounts of the gasoline blend in amount of up to about five volume percent. Butane is, of course, a low cost ingredient with a high octane number and affords a more economical product with a generally higher octane number. With MTBE and TAME, while neither is low in cost, both are characterized by high octane, and thus provide premium fuel products.

The fuel product and process according to the present invention will be further defined and understood by reference to the following examples.

EXAMPLE 1

Two gallons of food grade M d-limonene obtained from oranges was charged to a crude petroleum still with 15 theoretical plate column and distilled according to ASTM D 2892, operating at an reflux ratio of 1 to 1. d-limonene product was recovered in a temperature range from an initial boiling point of 346° F. to an end point of 382° F., leaving approximately 10 volume percent in the still. A highly purified d-limonene product was thus obtained having a water content of 0.1 weight percent.

The distilled d-limonene was then passed to the upper end of a glass column packed with silica gel and permitted to trickle through the column. Water content measured 0.01 weight percent after the drying operation.

Subsequent to drying of the distilled d-limonene, the d-limonene was fed to a high pressure stainless steel reaction vessel 30 inches high and six inches in diameter equipped with an inlet line for hydrogen. After charging the vessel with the d-limonene and a stoichiometric excess of hydrogen, the vessel was closed and maintained at 800° F. and 500 pounds per square inch pressure for about 20 minutes. Thereafter, the vessel was allowed to cool with appropriate pressure bleed off. The hydrogenerated d-limonene was then removed and tested to determine the effect of hydrogenation.

A Varian gas-liquid chromotography unit was employed to determine the purity of the processed d-limonene. Results indicated 97.8 volume percent purity. Standard nuclear magnetic resonance testing using Perkin-Elmer apparatus was then employed to determine that the d-limonene had become saturated.

EXAMPLE 2

Food grade M d-limonene was processed as specified in Example 1 except that the distilled d-limonene was admixed with an anti-oxidant instead of being hydrogenated. Particularly, the distilled d-limonene was charged into a vessel. N,N' di-secondary butyl para-phenylenediamine was then injected into a conventional positive displacement injector system along with nitrogen and the two were injected into the d-limonene charge at a rate of 10 pounds per 1000 barrels of d-limonene. The admixture of the anti-oxidant and d-limonene was then collected.

Examples of other anti-oxidants or gum inhibitors that may be employed according to the present invention are: N,N'disalicylidene-1,2 propanediamine; N,N'di (I-ethyl-2-methylpentyl) para-phenylenediamine; N, N'bis-(I, 4-diamethylpentyl)-p-phenylenediamine; and N, secondary butyl, N' phenyl-para-phenylenediamine;

The limonene processed according to Example 2 was then tested for conformance with certified ASTM standards for refined petroleum products. The physical properties listed in TABLE I were tested according to the ASTM test methods listed in TABLE I. Results are reported in Table I along with Colonial Pipeline standards for such properties for 87 octane unleaded gasoline.

TABLE I

COMPARISON OF PHYSICAL PROPERTIES OF PROCESSED LIMONENE AND 87 OCTANE UNLEADED GASOLINE STANDARDS

| Test Method, ASTM | Property Tested | Gasoline Standards | Limonene Fuel |
|---|---|---|---|
| D130 | Cu Corrosion 3 hrs.@ 122° F. | 1 | 1 |
| D381 | Existent Gum mg/100 ml. | 4 | <1.0 |
| D3237 | Lead content g/gal | 0.01 | Nil |
| D1266 | Sulfur, wt % | 0.10 | 0.0003 |
| D3227 | Mercaptan sulfur, wt. % | 0.002 | Nil |
| D525 | Oxidation stability, min. | <240 | <240 |
| D3606 | Benzene, wt % | 4.9 | Nil |
| | Oxygenates | Report | Nil |
| | Oxygen, wt. % | 2 | Nil |
| D2699 | Octane No., Research | | 88.5 |
| D2700 | Octane No., Motor | | 72.5 |

From a comparison of the tests of processed limonene to established gasoline standards, it can be seen that all of the gasoline standards are met by the limonene. Consequently, limonene processed according to the present invention can be blended with commercial refined petroleum products without causing unacceptable deviation from established standards for same for pipeline transport.

EXAMPLE 3

Quantities of limonene processed according to Example 2 of the present invention, 87 octane commercial Amoco gasoline, and blends of the limonene and the gasoline were distilled according to ASTM test method D86 to determine boiling ranges and distillation distribution of the products. Results are Tabulated in Table II. In Table II, the legend IBP refers to initial boiling point (first drop) and EP refers to end point (a point where after continual increase in still temperature, a first temperature drop occurred), or the point where distillate collection was stopped.

TABLE II

DISTILLATION DISTRIBUTION

| Distillate % Evap. | Limonene (A) Temperature °F. | 87 Octane Gasoline (B) Temperature °F. | Blend 10% A 90% B °F. | Blend (20% A 80B) Temp. °F. |
|---|---|---|---|---|
| IBP | 346 | 97 | 104 | 104 |
| 10 | 350 | 122 | 122 | 136 |
| 50 | 350 | 210 | 252 | 284 |
| 90 | 350 | 359 | 366 | 368 |
| EP | 382 | 404 | 404 | 404 |
| Volume Recovery, % | 98.0 | 96.0 | 96.5 | 97.0 |

Colonial Pipeline has established certain distillation standards according to ASTM D86 for classes of gasoline which are set forth in Table III.

TABLE III

| Southern Grade Gasolines | Class | Northern Grade Gasolines | Class |
|---|---|---|---|
| Jan, Feb, Mar, Nov, Dec. | D | Dec, Jan, Feb. | E |
| April, May, June, July | C | | |
| Sept., Oct. | C | Mar, Apr, Oct, Nov. | D |
| August | B | May, Jun, Jul, Aug, Sept. | C |

| Distillation: ASTM D86 | B | C | D | E |
|---|---|---|---|---|
| 10% evap. °F. max. | 149 | 140 | 131 | 122 |
| 50% evap. °F. min. | 170 | 170 | 170 | 170 |
| 50% evap. °F. max. | 245 | 240 | 235 | 230 |
| 90% evap. °F. max. | 374 | 365 | 365 | 365 |
| End Point °F. max. | 430 | 430 | 430 | 430 |

Referring to Tables II and III it can be seen that for Southern and Northern grade gasolines most of the distillation characteristics for the limonene-gasoline blends fell within the standards set by Colonial Pipeline. Further, in most instances where the characteristic is not met, it is the maximum temperature for the particular percentage of evaporation of the product. Since the concern of the pipeline company would obviously be directed to potential fuel loss while the fuel is being transported through its lines, the noted slight maximum temperature deviations should present no problem. Also, as indicated, the above comparisons are made for both Southern and Northern grade gasolines for all seasons of the year.

EXAMPLE 4

The distillate products listed in Table II were further analyzed to determine Reid vapor pressure (ASTM D323) and octane numbers. Results are tabulated in Table IV.

TABLE IV

REID VAPOR PRESSURE AND OCTANE NUMBER DATA

| | Limonene (A) | 87 Octane Amoco Gasoline (B) | Blend 10% A/ 90% B | Blend 20% A/ 80% B |
|---|---|---|---|---|
| Reid Vapor Pressure | 0.1 | 9.1 | 6.6 | 3.8 |
| Octane-Research (R) | 88.8 | 91.6 | 92.3 | 92.6 |
| Octane-Motor (M) | 72.5 | 82.8 | 81.7 | 80.4 |
| $\frac{R+M}{2}$ | 80.6 | 87.2 | 87.0 | 86.5 |

As can be seen from the data in Table IV, a blend of 10 volume percent processed limonene (A) and 90 volume percent commercial gasoline (B) exhibited a significantly lower vapor pressure (6.6) than gasoline alone (9.1). At the same time the same blend exhibited only a minor reduction in octane number (87.2 to 87.0). Such phenomona indicates that a limonene-gasoline blend could also include extenders for the gasoline to reduce cost and/or increase the octane number for the blend. For example, five percent butane could be substituted for the gasoline constitutents which would lower cost of the mixture and raise the octane number. Likewise, high octane such as MTBE and TAME, though more expensive, could be employed to produce a premium fuel blend.

EXAMPLE 5

Comparative analyses were also made between limonene processed according to Example 2 and 40 cetane diesel fuel similar to those conducted for gasoline fuel. Where available ASTM test procedures were employed. Results are tabulated in Table V, with the designation min=minimum and max=maximum.

TABLE V

ANALYSIS OF PROCESSED LIMONENE COMPARED TO SPECIFICATIONS FOR DIESEL OIL - 40 CETANE

| Test ASTM | Test Description | 40 Cetane Diesel Specs. | Processed Limonene |
|---|---|---|---|
| D287 | Gravity API, min. | 30.0 | 36.0 |
| D1500 | Color, ASTM, max. | 2.5 | 0 |
| D130 | Cu Corrosion @ 122° F., max | 1 | 1 |
| D3227 | Mercaptan S, ppm, max | 30 | 0 |
| D1266 | Sulphur, wt % | 0.29 | 3 ppm |
| D613 | Cetane index, min. | 40 | not measurable on index scale |
| D93 | Flash point, °F., min, | 140 | 121 |
| D97 | Pour Point, °F. | −5 | −75 |
| D86 | Distillation, °F. | | |
| | IBP, min. | 330 | 346 |
| | 10%, max. | | 350 |
| | 90% max. | 640 | 350 |
| | EP, max. | 690 | 382 |
| D2274 | Thermal Stability | 2.5 | See JFTOT results |
| D445 | Viscosity, cst @ 100° F. | 2.0–3.6 | .8 |
| D482 | Ash, wt %, max. | .01 | Nil |
| D1796 | B,S & W, Vol %, max. | .05 | Nil |
| D2500 | Cloud Point, max. | +15 | N/A |
| D524 | Carbon residue | 0.35 | |

The carbon residue, though not measured, will be quite low due to the fact the existent gum level is known to be quite low with high purity limonene product.

As can be seen from Table V, with the exception of flash point, all of the measured physical properties of the processed limonene of the present invention meet the standard specifications for 40 cetane diesel fuel oil. Blending of the instant limonene with diesel fuel would bring the flash point criteria within specification as is seen below.

EXAMPLE 6

A blend of 10 volume percent processed limonene and 90 volume percent 40 cetane diesel oil was produced, and tested for certain properties as listed in Table VI below. Results are compared to like test results for commercial diesel fuel (50 cetane Amoco).

TABLE VI

ANALYSIS OF LIMONENE/DIESEL FUEL BLEND (10/90) COMPARED TO 40 CETANE DIESEL FUEL

| Test ASTM | Test Description | Diesel Fuel | Blend 10%/90% |
|---|---|---|---|
| D287 | Gravity, API | 38.0 | 35.8 |
| D86 | Distallation, °F. | | |
| | IBP | 376 | 366 |
| | 10% | 423 | 398 |
| | 50% | 505 | 496 |
| | 90% | 606 | 598 |
| | EP | 650 | 648 |
| | Recovery, Vol. % | 98.0 | 98.5 |
| D976 | Cetane Index | 51.5 | 48.0 |

As can be seen from the data of Table VI, a 10/90 volume percent blend of processed limonene and commercial diesel fuel compound to commercial diesel fuel exhibits only a slight change in distillation characteristics with a significant reduction in cetane index. Also, based on the data from Table V, it is apparent that the processed limonene serves as a pour depressant for the diesel fuel which will be significant in the colder climates. Further, it is apparent that limonene will be a suitable substitute for light cycle oils that are conventionally blended with virgin diesel fuels. Since the light cycle oils are at a premium, the substitution availability will be quite beneficial to the industry. Such blending techniques thus provide a suitable fuel product with attendant cost efficiencies and product improvement.

EXAMPLE 7

Limonene processed according to Example 2 was tested for other physical characteristics relevant to the petroleum industry. Each of the tests conducted are specified in Table VII along with its ASTM test method.

TABLE VII

LIMONENE TEST RESULTS

| Test ASTM | Test Description | Limonene |
|---|---|---|
| D56 | Flash point, °F. (Closed Cup) | 121 |
| D92 | Flash point, °F. (Cleveland Open Cup) | 150 |
| D1298 | Specific Gravity 60/60F | 0.085 |
| | Gravity, API @ 60° F. | 36.0 |
| D1094 | Water reaction: | 1 |
| | Interface condition | |
| | Separation rating | 1 |
| | Change in water, ml | −1 |
| D3114 | Electrical conductivity picosiemens/meter | 9.46 |
| D3241 | JFTOT (Thermal oxidation stability - Jet fuel) | |
| | Pressure drop, mm. Hg. | 0 |
| | Preheater deposit | Code 0 |

TABLE VII-continued

| Test ASTM | LIMONENE TEST RESULTS Test Description | Limonene |
|---|---|---|
| D-2382 | Net heat of combustion, BTU/lb. | 18,221 |
| | Existent Gum, mg/100 Nil | 1.0 |

All of the characteristics included in Table VII are important to the success or failure of fuels. Notably, with flash point measurements as high as obtained it is apparent that the limonene is significantly less volatile than conventional gasolines, aviation and jet fuels, and one would not expect that the processed limonene could be used to start and operate a conventional spark igniter engine. As pointed out hereinafter, however, such is possible. The gravity measurements, as noted above, indicate the suitability of limonene as a blending component with diesel fuels. Water reaction tests are important, particularly as to jet fuels. The jet fuels are hygroscopic in nature and thus have a proclivity for picking up water during storage, during passage through pipelines and the like. The results indicate good resistance to water pickup and thus will afford an improvement in this area for jet fuels.

When fuels are being pumped through pipelines, they tend to pick up a static charge, and if not properly dissipated, could result in explosion in the event of a spark along the line. Consequently, a relaxation time is considered (time to dissipate a static charge). Limonene results as to electrical conductivity again point to successful blending, and product improvement.

Thermal stability, as discussed above, is quite significant in the sense of gum formations which are definitely to be avoided. According to jet fuel standards, a maximum pressure drop of 25 mm.Hg may be tolerated while preheater deposits are rated from Code 0 to Code 3 (increase in deposits). Limonene clearly meets both standards.

Heat capacity likewise is obviously important. For jet fuels a minimum of 18,400 BTU/lb is required. Unblended limonene measured 18,221 BTU/lb. and thus almost meets the standard in pure form. When included in a blend with jet fuel, heat capacity of the blend is clearly above minimum standards.

EXAMPLE 7

Unblended d-limonene processed according to Example 2 was utilized to operate an unmodified Chevrolet internal combustion engine in a late model Chevrolet automobile. The fuel line from the gas tank was disconnected and the engine was run until it ran out of gasoline and then stopped. The d-limonene in a separate container was fed directly to the carbureator. The engine then restarted without any difficulty and continued to run for approximately five uninterrupted hours. Thereafter, the engine was turned off. During the hours of operation with d-limonene, no noticeable difference in operation was observed. It was concluded that the d-limonene successfully operated the engine.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

I claim:

1. A process for producing purified limonene comprising the steps of:

(a) providing a supply of limonene;

(b) distilling the limonene and removing the distillate fraction in a temperature range of from about 346° F. to about 382° F.;

(c) removing water from the distilled limonene.

2. A process as defined in claim 1 wherein the limonene supplied is food grade d-limonene from citrus plants.

3. A process as defined in claim 1 wherein water is removed from the distilled limonene by passing same through a dessicant.

4. A process as defined in claim 3 wherein the dessicant is silica gel.

5. A process as defined in claim 1 comprising further treating the distilled limonene to preclude the formation of gums therefrom.

6. A process as defined in claim 5 wherein an antioxidant is added to the distilled limonene to inhibit gum formation.

7. A process as defined in claim 5 wherein the distilled limonene is hydrogenated to convert the limonene to a saturated paraffin whereby gum formation is precluded.

8. A process as defined in claim 1 wherein the limonene is distilled at atmospheric pressure.

9. A process as defined in claim 5 wherein the distilled limonene is hydrogenated to convert the limonene to a saturated paraffin.

* * * * *